US006892037B2

(12) United States Patent
Ohkubo

(10) Patent No.: US 6,892,037 B2
(45) Date of Patent: May 10, 2005

(54) IMAGE FORMING APPARATUS, CONTROL SYSTEM THEREFOR, CARTRIDGE, AND MEMORY DEVICE MOUNTED IN CARTRIDGE

(75) Inventor: Kazuhiro Ohkubo, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/369,559

(22) Filed: Feb. 21, 2003

(65) Prior Publication Data

US 2003/0161642 A1 Aug. 28, 2003

(30) Foreign Application Priority Data

Feb. 25, 2002 (JP) ..... 2002-047557

(51) Int. Cl.[7] ..... G03G 15/08
(52) U.S. Cl. ..... 399/27; 399/29
(58) Field of Search ..... 399/9, 24, 25, 399/27, 28, 29, 30, 262

(56) References Cited

U.S. PATENT DOCUMENTS 5,450,177 A * 9/1995 Oyama ..... 399/62
5,495,320 A * 2/1996 Araki et al. ..... 399/256
6,266,492 B1 * 7/2001 Maehara ..... 399/12

* cited by examiner

*Primary Examiner*—Hoan Tran
(74) *Attorney, Agent, or Firm*—Fitzpatrick, Cella, Harper & Scinto

(57) ABSTRACT

The image forming apparatus corrects the rotation number of a replenishing screw according to the toner replenishing amount using a correction table stored in advance in the case where a toner is replenished according to the density of the toner in the developing container, and controls the rotation of the replenishing screw according to the corrected rotation number to replenish the toner. Thus, the suitable amount of toner can be timely replenished into the developing container.

26 Claims, 14 Drawing Sheets

32

| ROTATION NUMBER C | 0—1.0 | 1.0—2.0 | 2.0—3.0 | 3.0— |
|---|---|---|---|---|
| CORRECTION COEFFICIENT K | 0.9 | 1.1 | 1.3 | 1.4 |

FIG. 16

32Y

| ROTATION NUMBER C | 0—1.0 | 1.0—2.0 | 2.0—3.0 | 3.0— |
|---|---|---|---|---|
| CORRECTION COEFFICIENT k | 0.9 | 1.1 | 1.3 | 1.4 |

32M

| ROTATION NUMBER C | 0—1.0 | 1.0—2.0 | 2.0—3.0 | 3.0— |
|---|---|---|---|---|
| CORRECTION COEFFICIENT k | 1.0 | 1.0 | 1.1 | 1.3 |

32C

| ROTATION NUMBER C | 0—1.0 | 1.0—2.0 | 2.0—3.0 | 3.0— |
|---|---|---|---|---|
| CORRECTION COEFFICIENT k | 1.0 | 1.0 | 1.3 | 1.4 |

32K

| ROTATION NUMBER C | 0—1.0 | 1.0—2.0 | 2.0—3.0 | 3.0— |
|---|---|---|---|---|
| CORRECTION COEFFICIENT k | 1.0 | 1.1 | 1.1 | 1.3 |

IMAGE FORMING APPARATUS, CONTROL SYSTEM THEREFOR, CARTRIDGE, AND MEMORY DEVICE MOUNTED IN CARTRIDGE

BACKGROUND OF THE INVENTION

1. Field of the Invention

The present invention relates to an image forming apparatus, such as a copying machine, a printer, or a facsimile machine, which includes a developing apparatus using a toner and conducts image forming operations by an electrophotographic method or the like; a control system for the image forming apparatus; a cartridge; and a memory device mounted in the cartridge.

2. Related Background Art

In an image forming apparatus, such as a copying machine or a printer, an electrophotographic photosensitive member functioning as an image bearing member is charged by a charging apparatus and exposed by an exposure apparatus to form an electrostatic latent image, according to image information, on the surface of the electrophotographic photosensitive member, and the formed electrostatic latent image is developed by a developing apparatus to visualize it as a developer image. Then, the developer image is transferred to a transfer material, such as a sheet, by a transfer apparatus, this toner image is fixed on the transfer material by a fixing apparatus, and the transfer material is discharged.

As the above-mentioned developing apparatus of the image forming apparatus, for example, a two-component developing apparatus (hereinafter referred to as a developing apparatus) 101, for conducting developing using a two-component developer (hereinafter referred to as a developer) t containing a non-magnetic toner and a magnetic carrier as shown in FIG. 10, can be used.

The developing apparatus 101 includes a developing sleeve 103, which is located opposite to a photosensitive drum 100, functioning as an image bearing member, in an opening portion of a developing container 102 and rotatable in the direction of an arrow adjacent developing sleeve 103 in FIG. 10 (counterclockwise direction), a magnet roller 104 fixedly located in the developing sleeve 103, a developer regulating blade 105 for regulating the layer thickness of the developer t borne on the developing sleeve 103, agitating screws 106*a* and 106*b* for agitating the developer t contained in the developing container 102 and feeding it in the developing-sleeve side, a toner replenishing container 107 in which a toner is contained, a replenishing screw 109 for replenishing toner from the toner replenishing container 107 into the developing container 102 through a toner replenishing port 108, and an inductance sensor 110 for measuring the density of the developer t in the developing container 102.

The agitating screws 106*a* and 106*b* are located in substantially parallel to and along an inner wall 111, functioning as a partition plate. The inner wall does not exist in both longitudinal end portions of the agitating screws 106*a* and 106*b*, and these longitudinal end portions communicate with each other through communication portions (not shown). When the developing sleeve 103 is rotated, the developer t is circulated by the rotated agitating screws 106*a* and 106*b* through the communication portions of both sides of the inner wall 111 so that it is borne on the developing sleeve 103. The developer t is composed by mixing a non-magnetic toner particle and a magnetic carrier particle.

Next, a developing process of visualizing an electrostatic latent image formed on the photosensitive drum 100 by a two-component magnetic-brush method using the above-mentioned developing apparatus 101 and a circulating system for the developer t will be described. Note that a voltage having a predetermined polarity is applied to the photosensitive drum 100 and a voltage having a predetermined polarity is applied to the developing sleeve 103.

With respect to the developer t in the developing container 102, a developer is drawn to an N2 pole of the magnet roller 104 in accordance with agitating and feeding by the agitating screws 106*a* and 106*b* rotated according to the rotation of the developing sleeve 103. The developer is regulated by the developer regulating blade 105 located perpendicular to the developing sleeve 103 through a process in which it is fed from an S2 pole to an N1 pole. Thus, the developer is formed as a thin layer on the developing sleeve 103. When the developer formed as the thin layer here is fed to an S1 pole as a developing main pole, a magnetic brush is produced by magnetic force. The electrostatic latent image on the photosensitive drum 100 is reversal-developed by the developer, which stands like the ears of rice. After that, the developer t on the developing sleeve 103 is returned into the developing container 102 by a repulsive magnetic field of an N3 pole and that of the N2 pole and agitated by the agitating screws 106*a* and 106*b*.

Further, the developer t in the developing container 102 is composed of a non-magnetic toner and a magnetic carrier and the magnetic permeability of the developer t is determined according to the carrier amount occupied per predetermined volume. Thus, when the magnetic permeability of the developer t is measured by the inductance sensor 110, the ratio between the toner and the carrier (hereinafter referred to as the toner density) can be detected.

Therefore, in the case where the toner density of the developer t is reduced according to the consumption of toner during developing, the reduced toner-density amount is measured at a time when the developer t fed by the agitating screw 106*b* transmits through the inductance sensor 110. The measurement information is outputted to a toner-replenishing control apparatus 112. As described below in detail, the toner replenishing control apparatus 112 causes the replenishing screw 109 to operate based on the measurement information inputted from the inductance sensor 110 so that the necessary toner amount is replenished from the toner replenishing container 107 into the developing container 102 through the toner replenishing port 108. Thus, the toner density of the developer t in the developing container 102 is always kept constant.

Note that, for example, optical-type density-detecting means can be used as means for detecting the toner density in the developing container 102 in addition to using the inductance sensor 110.

As shown in FIG. 11, in the toner-replenishing control apparatus 112 as the conventional example described above, a measurement value of the inductance sensor 110 corresponding to a predetermined toner density is used as a density standard value (toner-density standard value) 113 of the developing apparatus 101 so that a predetermined value is stored. At the time of toner-density control during an image forming operation, a signal (density measurement information) from the inductance sensor 110 is compared with the above-mentioned density standard value 113 by a comparison circuit 114 of the toner-replenishing control apparatus 112, the shift amount of current toner density with respect to the toner density of a standard developer is determined, and the consumed toner amount, that is, the replenishing toner amount a is calculated.

The toner in the toner replenishing container 107 is replenished into the developing container 102 through the toner replenishing port 108 according to the rotation of the replenishing screw 109. The toner amount fed at a time when the replenishing screw 109 is rotated one turn (replenishing amount per one rotation by screw) b is stored in advance in the toner-replenishing control apparatus 112. Thus, at the time of toner density control during an image forming operation, a screw rotation number c as a value obtained by dividing the above calculated replenishing toner amount a by the toner amount fed at a time when the replenishing screw 109 is rotated one turn (replenishing amount per one rotation by screw) b is calculated. The replenishing screw 109 is rotated by the calculated screw rotation number c to replenish the toner.

Now, in the toner replenishing operation by the control of the conventional toner replenishing control apparatus 112 as described above, the replenishing screw 109 is rotated by an amount proportional to the calculated replenishing toner amount a. Thus, there is a case where the following inconvenience is caused.

In the conventional toner replenishing operation as described above, the toner amount fed according to the rotation of the replenishing screw 109 actually has no proportional relationship with the rotation number of the replenishing screw 109. This is because the fed toner cannot follow the rotation of the replenishing screw 109 in the case where the replenishing screw 109 is rotated a large number of turns.

Thus, the feeding toner amount, which is actually replenished into the developing container 102 according to the screw rotation number c of the replenishing screw 109, which is determined by the above-mentioned conventional method, is shifted with respect to the calculated replenishing toner amount a so that the toner density in the developing container 102 is unstable. Therefore, in the worst case, fog on an image due to under-agitating of the developer t resulting from over-replenishing of the toner is caused or a reduction in image density resulting from a shortage of the toner replenishing amount is caused.

FIG. 12 shows, in the conventional toner replenishing operation as described above, the actual relationship between the rotation number of the replenishing screw 109 and the replenished toner amount (A in the drawing) and the relationship in the case where it is assumed that the rotation number of the replenishing screw 109 and the replenished toner amount have a proportional relationship (B in the drawing).

As shown by A in FIG. 12, up to now, with respect to the toner amount actually fed according to the rotation of the replenishing screw 109, the toner replenishing amount per one rotation tends to decrease as the rotation number of the replenishing screw 109 increases. Thus, in the case where the required toner replenishing amount is large, that is, in the case where the rotation number of the replenishing screw 109 becomes larger, the toner replenishing amount becomes insufficient.

Therefore, an object of the present invention is to provide an image forming apparatus capable of always replenishing the suitable amount of toner even in the case where a developing operation is conducted in which the replenishing toner amount required according to the measured density of the toner is large.

SUMMARY OF THE INVENTION

It is an object of the present invention to provide an image forming apparatus capable of suitably replenishing a toner, a control system for the image forming apparatus, a cartridge, and a memory device mounted in the cartridge.

Another object of the present invention is to provide an image forming apparatus capable of always replenishing the suitable amount of toner even in the case where a developing operation is conducted in which the replenishing toner amount required according to the measured density of the toner is large, a control system for the image forming apparatus, a cartridge, and a memory device mounted in the cartridge.

A further object of the present invention is to provide an image forming apparatus for forming an image using a toner including: a developing container for containing the toner; density measuring means for measuring the density of the toner in the developing container; a developer carrying member for bearing the toner and feeding the borne toner to a developing portion for developing an electrostatic latent image formed on an image bearing member; a toner replenishing container for containing the toner to be replenished into the developing container; a toner replenishing member for replenishing the developing container with the toner in the toner replenishing container; control means for calculating a toner amount replenished to the developing container based on the density measurement result obtained by the density measuring means and controlling rotation of the toner replenishing member in accordance with the calculated toner amount; and memory means for storing correction information according to a rotation number of the toner replenishing member, in which the control means corrects the rotation number of the toner replenishing member according to the calculated toner amount using the correction information.

A further object of the present invention is to provide a cartridge detachably attachable to an image forming apparatus for forming an image using a toner, including: a toner replenishing container for containing the toner; a toner supplying member for replenishing the toner to an image forming apparatus main body; and a memory for storing information related to the cartridge, in which the memory includes a memory region for storing correction information for correcting the rotation number of the toner replenishing member.

A further object of the present invention is to provide a memory device mounted in a cartridge detachably attachable to an image forming apparatus for forming an image using a toner, in which the cartridge includes: a toner supplying container for containing the toner; and a toner replenishing member for supplying the toner to an image forming apparatus main body, and in which the memory device includes a memory region for storing correction information for correcting the rotation number of the toner replenishing member.

A still further object of the present invention is to provide a control system for an image forming apparatus including an apparatus main body and a cartridge, in which the image forming apparatus includes: an image bearing member; a developing container for containing a toner; density measuring means for measuring the developer density in the developing container; a developer carrying member for bearing the toner and feeding the borne toner to a developing portion for developing an electrostatic latent image formed on the image bearing member; a toner replenishing container for containing the toner to be replenished into the developing container; a toner replenishing member for replenishing the developing container with the toner in the toner replenishing container; and control means for calculating the toner amount replenished to the developing container based on the density measurement result obtained by the density measuring means and controlling rotation of the toner replenishing member in accordance with the calculated toner amount, in which the control system includes a memory device mounted in the cartridge, in which the memory device includes a memory region for storing correction information for correcting the rotation number of the toner replenishing member, and in which the control means corrects the rotation number of the toner replenishing member using the correction information stored in the memory region.

Other objects and aspects of the invention will become apparent from the following description of embodiments with reference to the accompanying drawings.

BRIEF DESCRIPTION OF THE DRAWINGS

FIG. 16 shows a correction table for correcting the rotation number of a replenishing screw in Embodiment 3.

DESCRIPTION OF THE PREFERRED EMBODIMENTS

Figure 1:
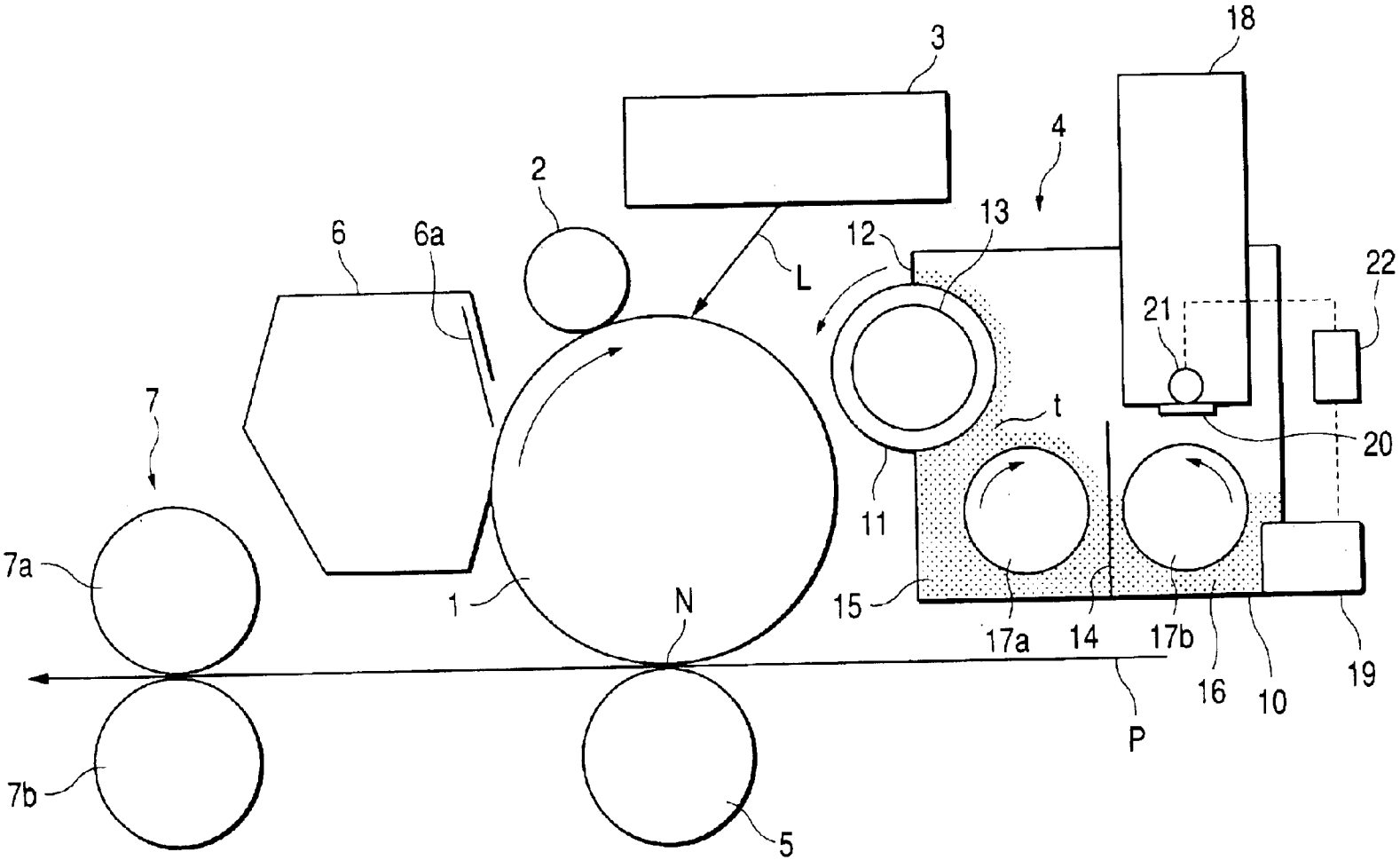
FIG. 1 is a schematic structural view showing an image forming apparatus provided with a developing apparatus according to Embodiment 1.

Hereinafter, the present invention will be described with reference to embodiments shown in the drawings.

(Embodiment 1)

FIG. 1 is a schematic structural view showing an image forming apparatus provided with a developing apparatus according to Embodiment 1 of the present invention.

The image forming apparatus is provided with a charging roller 2, an exposure apparatus 3, a developing apparatus 4, a transferring roller 5, and a cleaning apparatus 6 around a drum-type electrophotographic photosensitive member (hereinafter referred to as a photosensitive drum) 1 functioning as an image bearing member. In addition, a fixing apparatus 7 is located between the photosensitive drum 1 and the transferring roller 5 in a transfer-material transporting-direction downstream side of a transferring nip portion N.

The photosensitive drum 1 is a negatively charged organic photosensitive member in this embodiment and has a photosensitive layer (not shown) on a drum base (not shown) made of aluminum with a diameter of 30 mm. The photosensitive drum 1 is rotated at predetermined peripheral speed (for example, 105 mm/sec.) in the direction of an arrow inside drum 1 in FIG. 1 (clockwise direction), and uniformly charged to a negative polarity by the charging roller 2, which is brought into contact therewith during the rotating process.

The charging roller 2, functioning as charging means, is rotatably in contact with the surface of the photosensitive drum 1 and uniformly charges the photosensitive drum 1 with a predetermined polarity and a predetermined potential by a charging bias applied from a charging-bias power supply (not shown).

The exposure apparatus 3 includes a laser driver, a laser diode, and a polygon mirror, which are not shown. Laser light modulated corresponding to a time-series, electrical, digital-image signal of image information inputted to the laser driver is outputted from the laser diode. The outputted laser light is scanned by the polygon mirror, which is rotated at a high speed, and image exposure of the surface of the photosensitive drum 1 through a reflection mirror (not shown) is conducted by the image exposure light L to form an electrostatic latent image on the photosensitive drum corresponding to the image information.

The developing apparatus 4 is two-component developing apparatus for conducting developing using a two-component developer containing a non-magnetic toner and a magnetic carrier (developer t) (the details of the developing apparatus 4 in this embodiment will be described later).

The transferring roller 5 as transferring means is in contact with the surface of the photosensitive drum 1 at a predetermined pressing force to form the transferring-nip portion N. A toner image on the surface of the photosensitive drum 1 is transferred to a transfer material P in the transferring-nip portion N between the photosensitive drum 1 and the transferring roller 5 by a transferring-bias applied from a transferring bias power supply (not shown).

The cleaning apparatus 6 has a cleaning blade 6*a*. Transfer residual toner left on the surface of the photosensitive drum 1 after transferring is removed by the cleaning blade 6*a*.

The fixing apparatus 7 has a rotatable fixing roller 7*a* and a pressure roller 7*b*. While the transfer material P is nipped and transported in a fixing nip between the fixing roller 7*a* and the pressure roller 7*b*, the toner image transferred onto the surface of the transfer material P is heated and pressurized to be thermally fixed.

Next, the image forming operation by the above-mentioned image forming apparatus will be described.

In image forming, the photosensitive drum 1 is rotated at predetermined peripheral speed (for example, 105 mm/sec.) in the direction of the arrow inside photosensitive drum 1 by drive means (not shown) and the surface thereof is uniformly charged by the charging roller 2.

Then, the image exposure light L is applied onto the charged photosensitive drum 1 by the exposure apparatus 3 to form an electrostatic latent image according to inputted image information. After that, toner charged to the same polarity as the charging polarity (negative polarity) on the photosensitive drum 1 is adhered to the electrostatic latent image formed on the photosensitive drum 1 by a developing sleeve 11 functioning as a developer carrying member of the developing apparatus 4 to which a developing bias with the same polarity as the charging polarity (negative polarity) on the photosensitive drum 1 is applied in a developing portion, thereby visualizing the electrostatic latent image.

Then, when the toner image on the photosensitive drum 1 reaches the transferring-nip portion N between the photosensitive drum 1 and the transferring roller 5, in accordance with this timing, the transfer material P, such as a sheet, is transported to the transferring-nip portion N by a registration roller (not shown). After that, the toner image on the photosensitive drum 1 is transferred to the transfer material P transported to the transferring-nip portion N by an electrostatic force generated between the photosensitive drum 1 and the transferring roller 5 by the transferring roller 5 to which a transferring bias with opposite polarity (positive polarity) to the toner is applied.

Then, the transfer material P to which the toner image is transferred is transported to the fixing apparatus 7. The transfer material P to which the toner image is transferred is heated and pressurized to be thermally fixed in the fixing nip between the fixing roller 7*a* and the pressure roller 7*b* and then discharged to the outside, thereby completing a series of image-forming operations. In addition, a transfer residual toner left on the surface of the photosensitive drum 1 after the toner image transferring operation is removed by the cleaning blade 6*a* of the cleaning apparatus 6 and recovered.

Next, the details of the developing apparatus 4 in Embodiment 1 of the present invention will be described.

The developing apparatus 4 includes a developing container 10 in which the developer t containing a non-magnetic toner and a magnetic carrier is contained. The developing sleeve 11, which is made of a non-magnetic material, such as stainless steel (SUS) functioning as a developer carrying member, is rotatably provided opposite to the photosensitive drum 1 in an opening portion of the developing container 10. As the above non-magnetic toner, a known toner, in which a coloring agent, a charging control agent, and the like are added to a binder resin, can be used. In this embodiment, a toner having a volume-average particle size of 5 $\mu$m to 15 $\mu$m is used. In addition, as the above magnetic carrier, a ferrite carrier, a resin-coated carrier, or the like can be suitably used. In this embodiment, a carrier having an average particle size of 5 $\mu$m to 70 $\mu$m is used.

A developer regulating blade 12 is provided close to the developing sleeve 11 in the opening portion of the developing container 10, is located above the developing sleeve 11, and regulates the layer thickness of the developer t borne on the surface of the developing sleeve 11.

Figure 2:
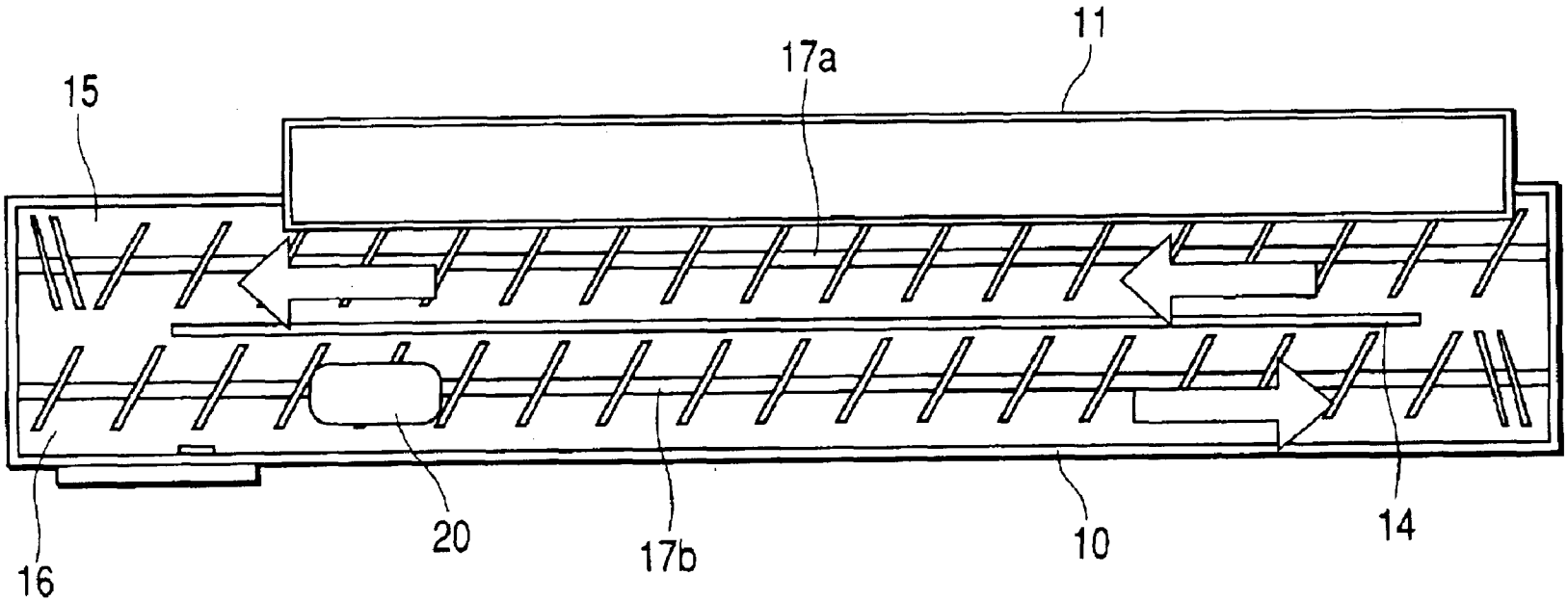
FIG. 2 is a schematic sectional view showing a developing container of the developing apparatus according to Embodiment 1.

A magnet roller 13 functioning as magnetic-field generating means is fixedly located in the developing sleeve 11. The magnet roller 13 has a plurality of poles. As shown in FIGS. 1 and 2, the developing container 10 is divided by a partition wall 14. Agitating screws 17*a* and 17*b* functioning as developer feeding member are respectively located in a divided first room 15 and a divided second room 16, respectively. The first room 15 and the second room 16 communicate with each other. The developer t is circulated in the first room 15 and the second room 16 according to the rotation of the agitating screws 17*a* and 17*b*.

The developer t in the developing container 10 is fed from the second room 16 to the first room 15 according to the rotation of the agitating screw 17*b*, and is further fed by the agitating screw 17*a* while being agitated. At this time, a part of the developer t is drawn with a drawing or draw-up pole of the magnet roller 13. The developer t drawn up with the draw-up pole (is regulated to a predetermined layer thickness by the developer regulating blade 12 and adhered onto the surface of the developing sleeve 11.

Then, according to the rotation of the developing sleeve 11, the developer t regulated to the layer thickness on the surface of the developing sleeve 11 is fed to the vicinity of the developing portion in which a developing pole of the magnet roller 13 is positioned, and the electrostatic latent image on the photosensitive drum 1 is developed.

Then, a developer left without contributing to the developing drops into the first room 15 of the developing container 10 by repulsive magnetic fields generated from magnetic poles) of the magnetic roller 13 according to the rotation of the developing sleeve 11. The developer which drops into the first room 15 is fed to the second room 16 according to the rotation of the agitating screw 17*a*, thereby contributing to the next developing operation.

Figure 3:
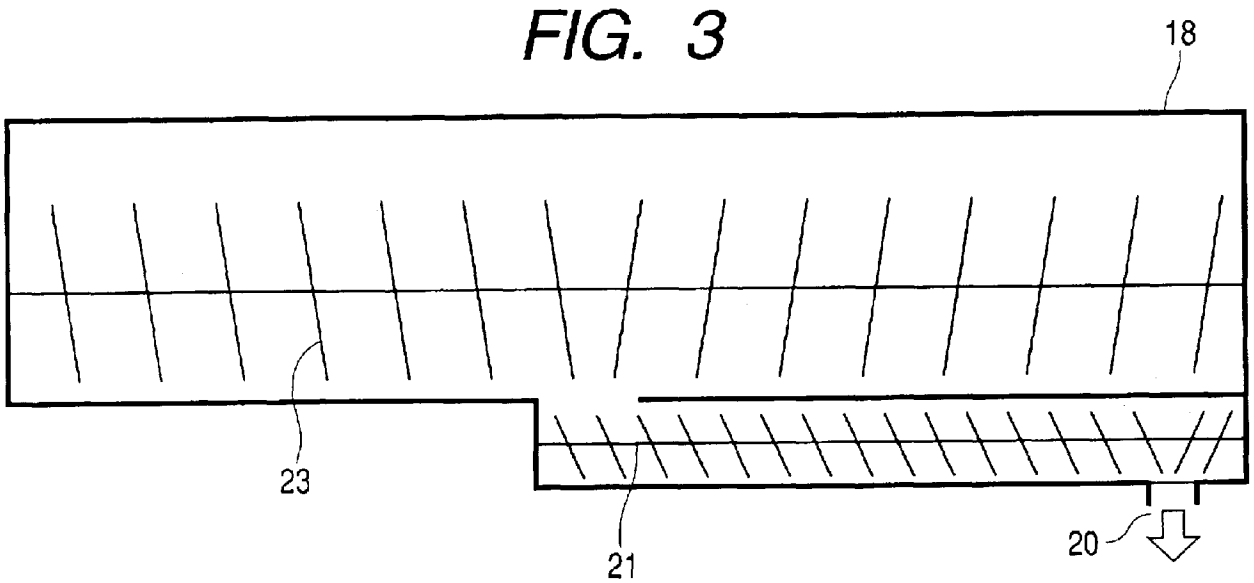
FIG. 3 is a schematic transverse sectional view showing a toner replenishing container in Embodiment 1.
Figure 4:
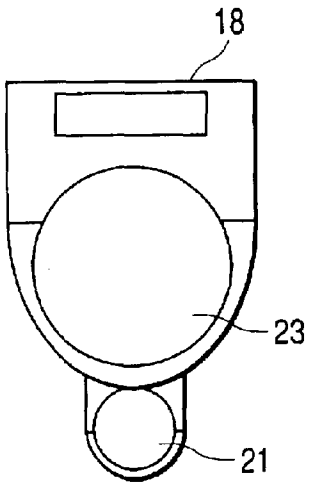
FIG. 4 is a schematic longitudinal sectional view showing the toner replenishing container in Embodiment 1.

Also, a toner replenishing container 18 is provided above the second room 16 of the developing container 10. An inductance sensor 19 for measuring the density of the developer t in the developing container 10 is provided for the second room 16. As shown in FIGS. 3 and 4, the toner replenishing container 18 has an agitating screw 23 for agitating toner in the toner replenishing container 18. Further, a rotatable replenishing screw 21 for replenishing the developing container 10 with toner through a toner replenishing port 20 is integrally provided. The toner replenishing container 18 having the replenishing screw 21 is integrally formed as a cartridge and detachably attachable to the developing container 10 of the developing apparatus 4.

With respect to the replenishing screw 21 in this embodiment, the outside diameter of the screw is 13 mm, the inside diameter of the screw is 8 mm, and the pitch of the screw is 8 mm. The replenishing screw 21 is rotated at two rotations per second. The interval between the inner wall of the toner replenishing container 18 and the outside diameter of the replenishing screw 21 is 1 mm.

Toner-density measurement information from the inductance sensor 19 is inputted to a toner-replenishing control apparatus 22. The toner-replenishing control apparatus 22 controls the rotation of the replenishing screw 21 based on the inputted toner-density measurement information and timely supplies the suitable amount of toner into the developing container 10 (the details of which will be described later). The toner-replenishing control apparatus 22 is provided in an image-forming-apparatus main body (not shown).

Next, the toner replenishing operation of the image forming operation of the above-mentioned developing apparatus 4 of this embodiment will be described.

First, after a main power supply (not shown) of the image forming apparatus is turned on so that predetermined activation preparation is completed, it enters a standby state (waiting state). When an image-forming-operation start signal is received when the apparatus is in the standby state, the image forming operation is started so that the photosensitive drum 1, the charging roller 2, the exposure apparatus 3, the developing apparatus 4, the transferring roller 5, the fixing apparatus 7, and the like are activated in succession.

Then, the developing sleeve 11 of the developing apparatus 4 is on standby in a state in which the developing sleeve stops until timing for developing is required, and rotated only in the case where developing is conducted.

After the developing operation is started, the developing sleeve 11 is started to rotate, and simultaneously the agitating screws 17*a* and 17*b* in the developing container 10 are rotated to start agitating of the developer t. At this time, the toner density is measured by the inductance sensor 19 and the measurement information is outputted to the toner-replenishing control apparatus 22.

Figure 5:
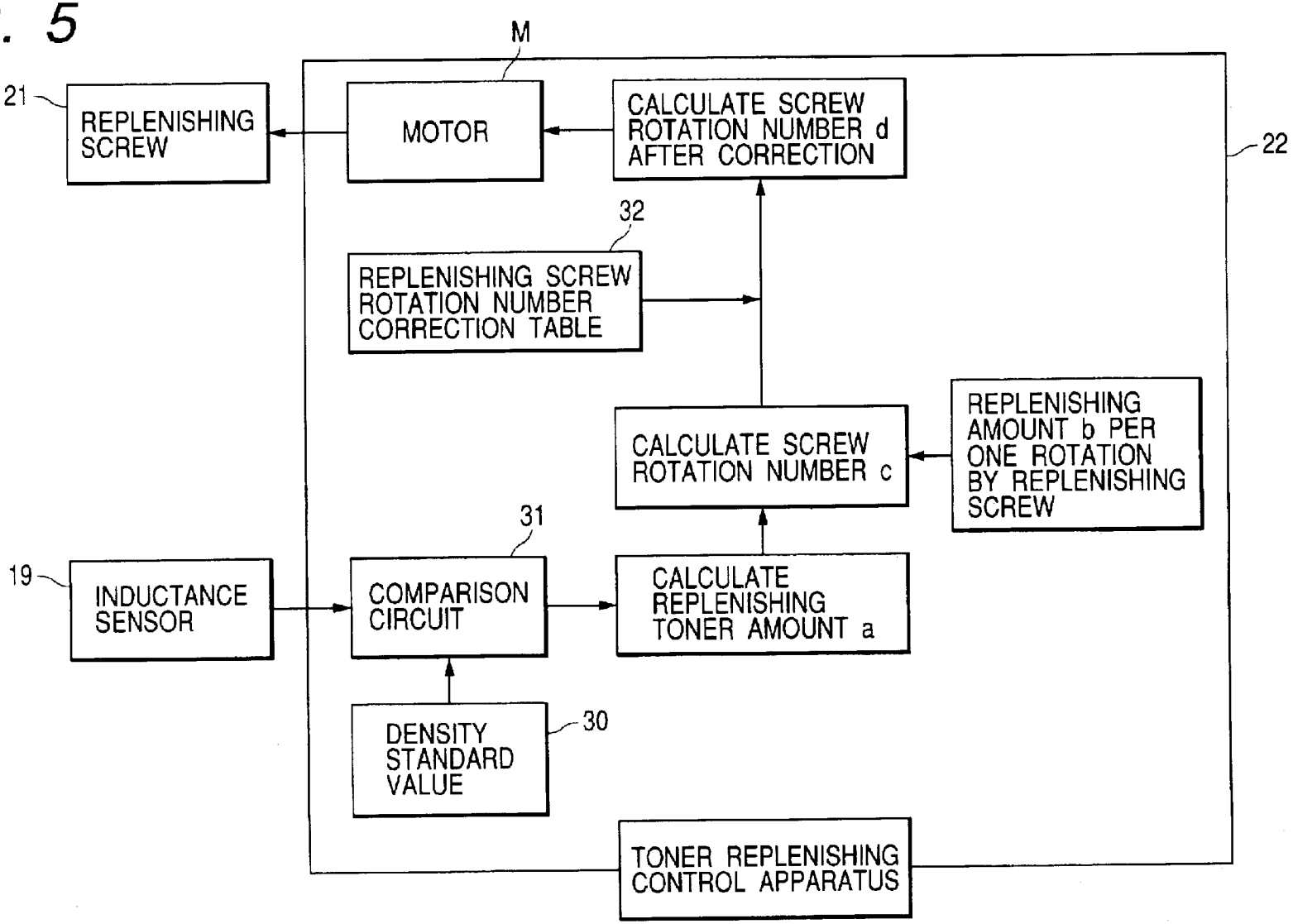
FIG. 5 is an explanatory view of toner-replenishing operating control by a toner-replenishing control apparatus in Embodiment 1.

As shown in FIG. 5, in the toner-replenishing control apparatus 22, a measurement value of the inductance sensor 19 corresponding to a predetermined toner density is used as a density standard value (toner-density standard value) 30 of the developing apparatus 4 in which a predetermined value is stored. In the toner density control performed during the image forming operation, measurement-value information (density-measurement value) from the inductance sensor 19 is compared with the above-mentioned density standard value 30 by a comparison circuit 31 of the toner-replenishing control apparatus 22. Thus, the shift amount of the current toner density with respect to the density standard value (toner-density standard value) 30 is determined, and the replenishing toner amount a, corresponding to the consumed toner amount, is calculated.

Also, the toner amount fed at a time when the replenishing screw 21 is rotated one turn (replenishing amount per one rotation by screw) b is stored in advance in the toner-replenishing control apparatus 22. The above calculated replenishing toner amount a is divided by the toner amount fed at a time when the replenishing screw 21 is rotated one turn (replenishing amount per one rotation by screw) b. Thus, the screw-rotation number c of the replenishing screw 21, which is required for replenishing the requested toner amount, is calculated.

Figure 11:
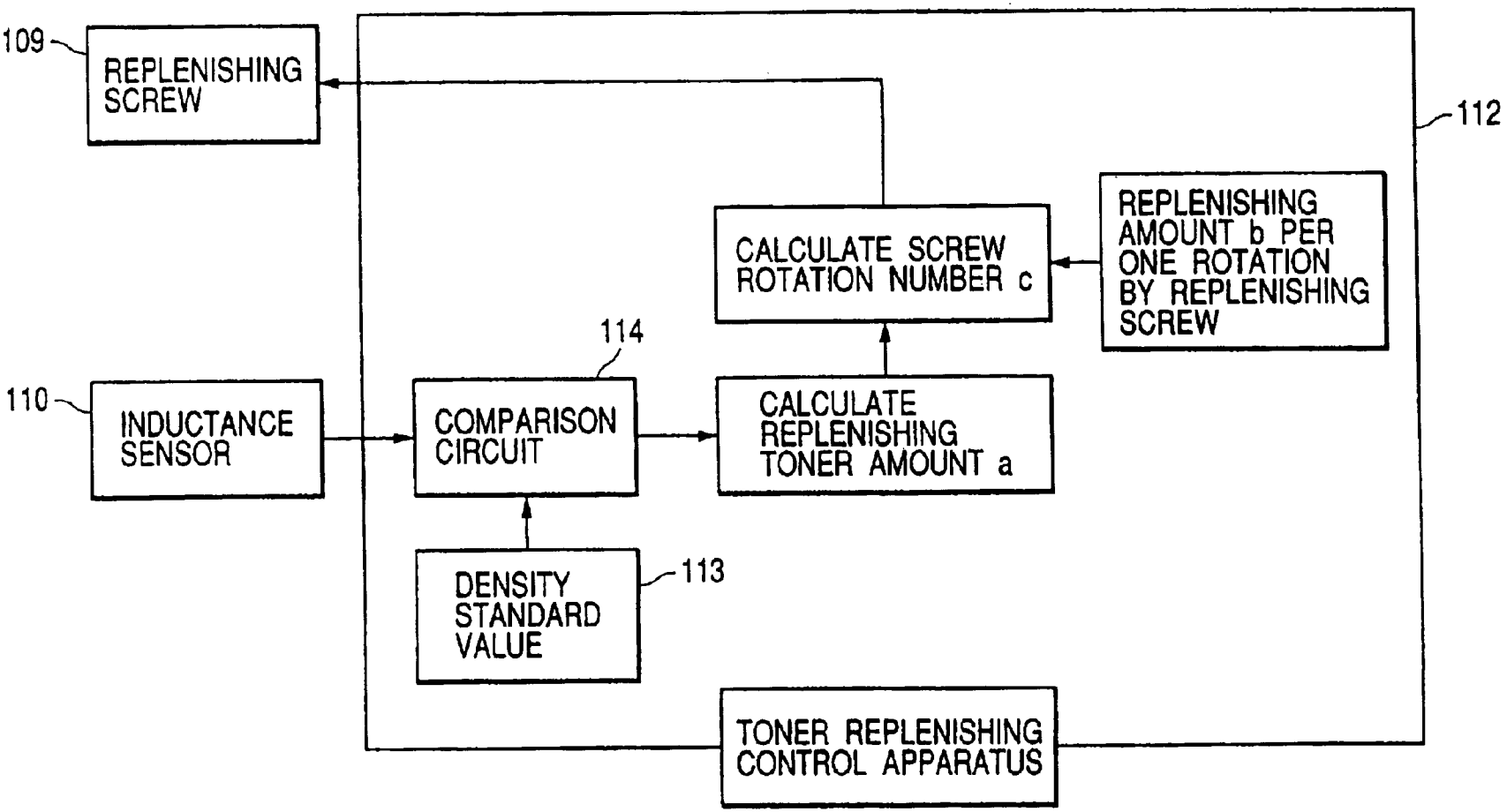
FIG. 11 PRIOR ART
FIG. 11 is an explanatory view of toner-replenishing operating control by a toner-replenishing control apparatus of the conventional example.

In this embodiment, the above-mentioned toner replenishing amount (replenishing amount per one rotation by screw) b is determined according to the actual toner replenishing amount in the case where the rotation number of the replenishing screw 21 is small (about 0 to 1 turn) as shown in FIG. 11 (A in the drawing).

Figures 6, 7:
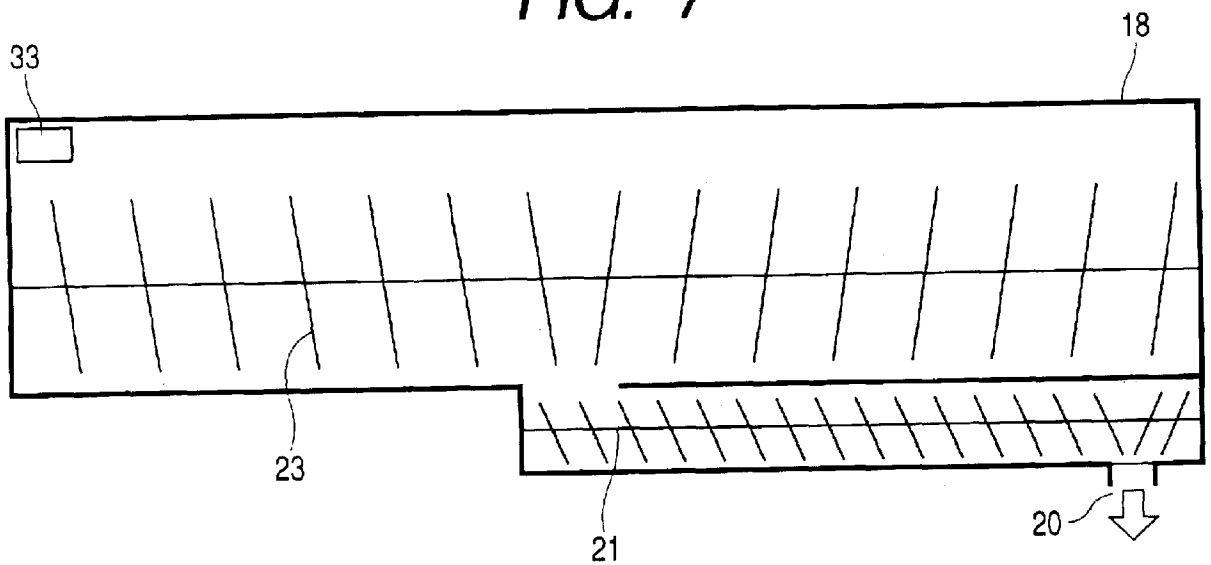
FIG. 6 shows a correction table for correcting the rotation number of a replenishing screw in Embodiment 1.
FIG. 7 is a schematic transverse sectional view showing a toner-replenishing container in Embodiment 2.

Also, in this embodiment, the toner-replenishing control apparatus 22 has a correction table 32 for correcting the rotation number of the replenishing screw 21 as shown in FIG. 6. Thus, the value of correction coefficient k, according to a value of the above-calculated screw-rotation number c of the replenishing screw 21, is read out from the correction table 32, and the calculated screw rotation number c is multiplied by the correction coefficient k to calculate the corrected rotation number of the replenishing screw 21 (screw rotation number after correction) d.

Specifically, in this embodiment, as shown in FIG. 6, the calculated screw rotation number c is divided into a range of 0 to 1, a range of 1 to 2, a range of 2 to 3, and a range of 3 or more, and the value of the correction coefficient k is determined as correction information according to the screw rotation number c. In the toner-replenishing control apparatus 22, a control signal is outputted to a motor M serving as a replenishing screw drive portion for the replenishing screw 21 such that the replenishing screw 21 is rotated by the rotation number (screw rotation number after correction) d corrected based on a value of the correction table 32 shown in FIG. 6. As the motor M, a pulse motor is employed in order to minutely control the rotation of the replenishing screw 21 according to the rotation number d from the toner-replenishing control apparatus 22.

Figure 12:
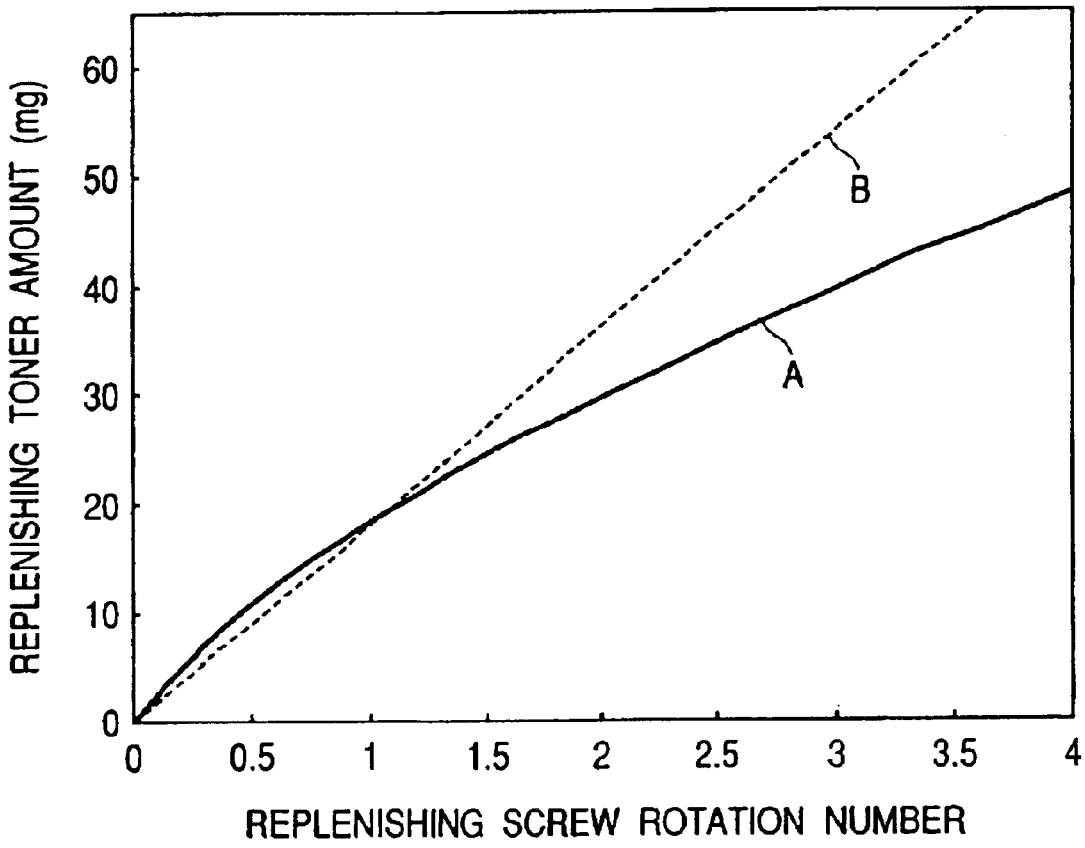
FIG. 12 PRIOR ART
FIG. 12 shows the relationship between the rotation number of the replenishing screw and the replenishing toner amount.

Thus, control is possible such that there is no proportional relationship between the rotation number of the replenishing screw 21 and the replenished toner amount as in the conventional case, and the rotation number (total rotation number) of the replenishing screw 21 becomes nonlinear with respect to the replenishing toner amount as shown by curve A in FIG. 12. Therefore, the suitable amount of toner is timely replenished from the toner replenishing container 18 into the developing container 10 through the toner replenishing port 20.

As described above, in this embodiment, the toner replenishing amount required according to the measured density of the toner becomes larger. Even in the case where the rotation number of the replenishing screw 21 becomes larger, the suitable amount of toner can be always replenished into the developing container 10. Thus, the density of the toner in the developer t can be always kept constant so that a preferable image can be obtained.

Note that, according to the structure in this embodiment, the inductance sensor 19 is used as the toner-density detecting means. However, the present invention is not limited to this, and therefore, for example, an optical-type density detecting sensor or the like can be also used. In addition, in this embodiment, the correction table with the numerical values as shown in FIG. 6 is used as the correction table for the screw rotation number of the replenishing screw 21. However, the present invention is not limited to this, and therefore a correction table with numerical values timely changed according to the specifications of the developing apparatus and the like can be also used.

(Embodiment 2)

According to the structure in Embodiment 1, the correction table 32 for correcting the screw rotation number of the replenishing screw 21 as shown in FIG. 6 is included in the toner replenishing control apparatus 22. According to a structure in this embodiment, as shown in FIG. 7, a memory apparatus 33 for storing the above-mentioned correction stable 32 is provided in the toner replenishing container 18. Other structures and operations are substantially the same as in the image forming apparatus provided with the developing apparatus in Embodiment 1, as shown in FIGS. 1 to 4 and the duplicated description is omitted here.

Figure 8:
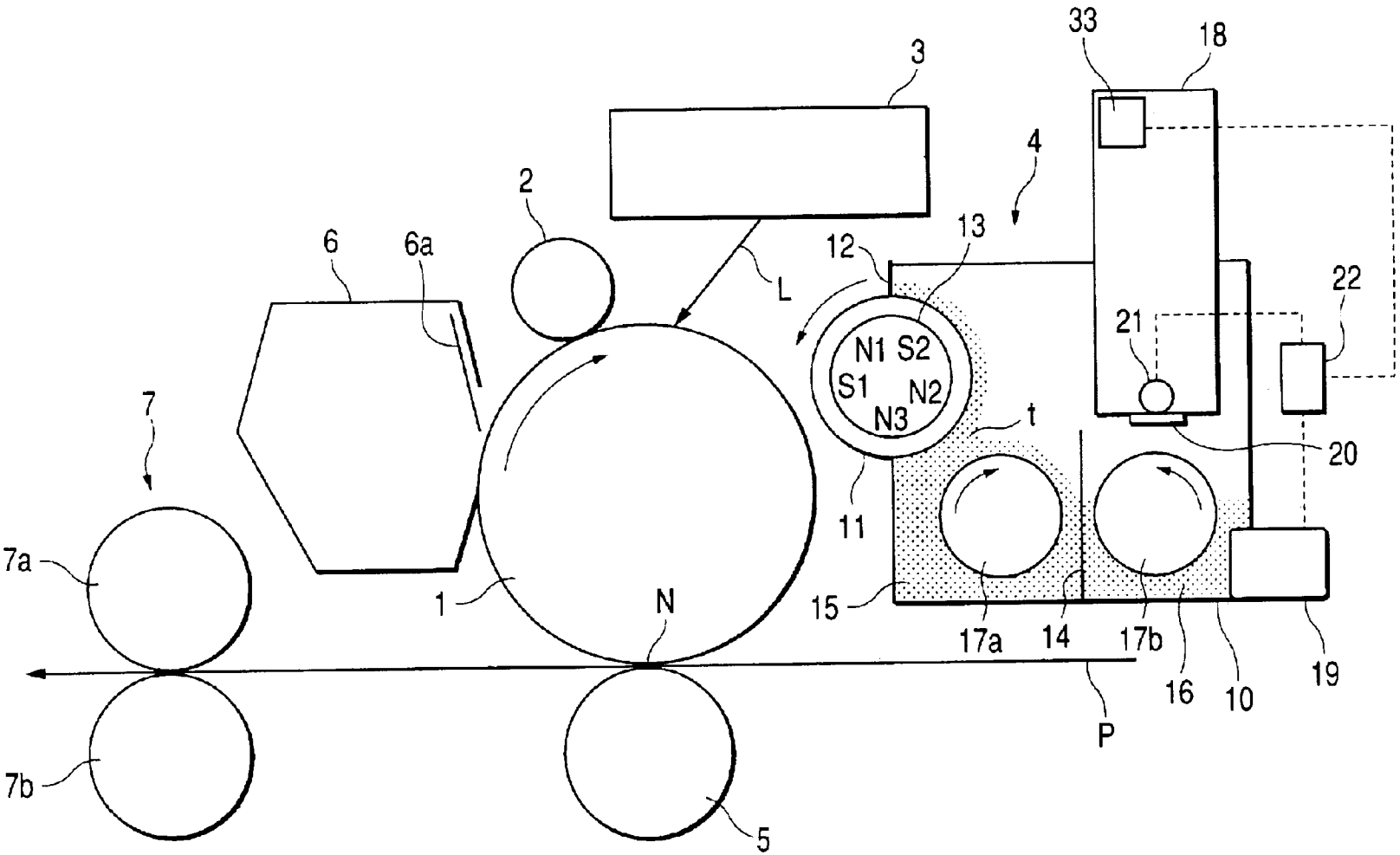
FIG. 8 is a schematic structural view showing an image forming apparatus provided with a developing apparatus according to Embodiment 2.

FIG. 8 is a schematic structural view showing an image forming apparatus provided with a developing apparatus according to Embodiment 2 of the present invention. It is different from Embodiment 1 at a point in which the memory apparatus 33 is provided in the toner replenishing container 18.

Figure 9:
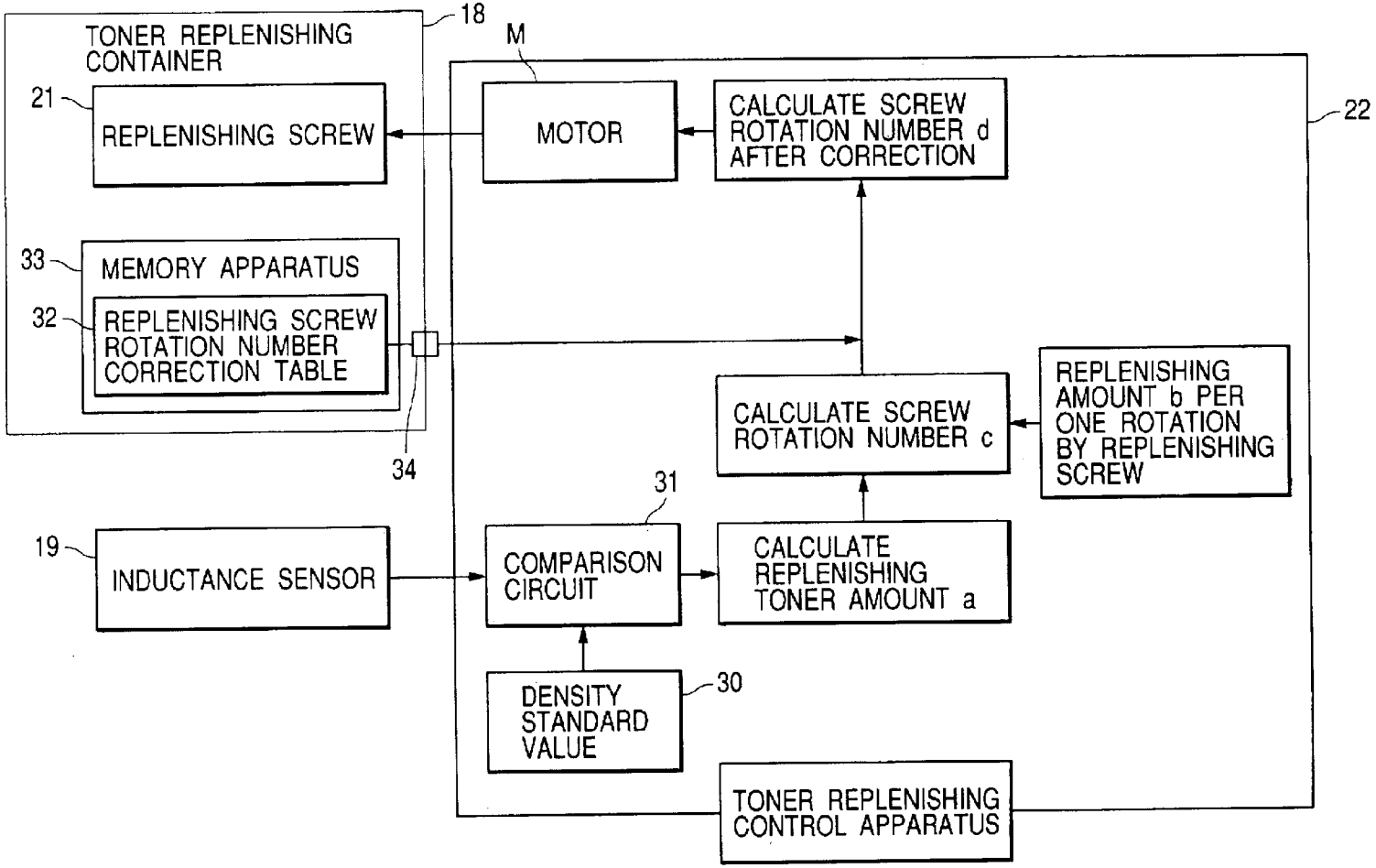
FIG. 9 is an explanatory view of a toner-replenishing operating control by a toner-replenishing control apparatus in Embodiment 2.
Figure 10:
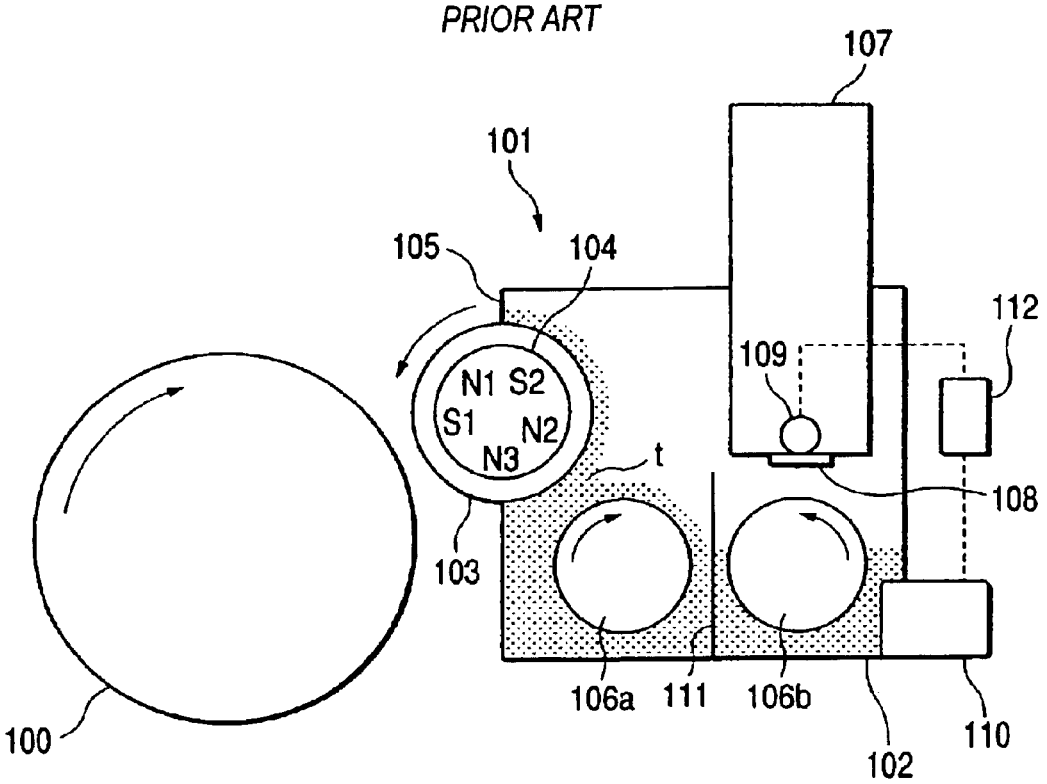
FIG. 10 PRIOR ART
FIG. 10 is a schematic structural view showing a developing apparatus of a conventional example.

As shown in FIG. 9, the memory apparatus 33 is electrically connected with the toner replenishing control apparatus 22 provided in the image forming apparatus main body (not shown) side through a connector 34 so that a state in which communication is possible is obtained. Note that an electrical connecting system with a connector may be used between the memory apparatus 33 and the toner replenishing control apparatus 22. Alternatively, although not shown, a radio communication system with an antenna or the like through radio wave (electromagnetic wave) may be used. In addition, as in Embodiment 1, the toner replenishing container 18 and the replenishing screw 21 are integrally constructed as a cartridge, and are detachably attachable to the developing containing 10 of the developing apparatus 4.

Hereinafter, the toner replenishing operation of the image forming operation (developing operation) of the developing apparatus 4 of this embodiment will be described.

First, after a main power supply (not shown) of the image forming apparatus is turned on so that predetermined activation preparation is completed, it enters a standby state (waiting state). When an image-forming-operation start signal is received in the standby state, the image forming operation is started so that the photosensitive drum 1, the charging roller 2, the exposure apparatus 3, the developing apparatus 4, the transferring roller 5, the fixing apparatus 7, and the like are activated in succession.

Then, the developing sleeve 11 of the developing apparatus 4 is on standby in a state in which the developing sleeve 11 stops until timing for developing is required, and is rotated only in the case where developing is conducted. After the developing operation is started, the developing sleeve 11 is started to rotate, and simultaneously the agitating screws 17*a* and 17*b* in the developing container 10 are rotated to start agitating of the developer t. At this time, the toner density is measured by the inductance sensor 19 and the measurement value information is outputted to the toner-replenishing control apparatus 22.

As shown in FIG. 9, in the toner replenishing control apparatus 22, a measurement value of the inductance sensor 19 corresponding to a predetermined loner density is used as a density standard value (toner-density standard value) 30 of the developing apparatus 4 in which a predetermined value is stored. In the toner density control during the image forming operation, measurement-value information (density-measurement value) from the inductance sensor 19 is compared with the above-mentioned density standard value 30 by the comparison circuit 31 of the toner-replenishing control apparatus 22. Thus, the shift amount of the current toner density with respect to the density standard value (toner-density standard value) 30 is determined, and the replenishing toner amount a, corresponding to the consumed toner amount, is calculated.

Also, the toner amount fed at a time when the replenishing screw 21 is rotated one turn (replenishing amount per one rotation by screw) b is stored in advance in the toner replenishing control apparatus 22. The above calculated replenishing toner amount a is divided by the toner replenishing amount fed at a time when the replenishing screw 21 is rotated one turn (replenishing amount per one rotation by screw) b. Thus, the screw rotation number c of the replenishing screw 21 which is required for replenishing the requested toner amount is calculated. The operation until now is the same as in Embodiment 1 shown in FIG. 5.

In this embodiment, the memory apparatus 33 provided in the toner replenishing container 18 has a memory portion (memory region) for storing the correction table 32 for correcting the rotation number of the replenishing screw 21. Thus, based on a correction coefficient k read out from the correction table 32 of the memory apparatus 33 by the control of the toner replenishing control apparatus 22, the screw rotation number c is multiplied by the value of the correction coefficient k corresponding to the value of the above calculated screw rotation number c of the replenishing screw 21 to calculate the corrected rotation number of the replenishing screw 21 (screw rotation number after correction) d. The numerical values of the correction table 32 are the same as in the case of Embodiment 1 as shown in FIG. 6.

Note that the memory apparatus 33 is a nonvolatile memory such as an NVRAM or a FeRAM (ferroelectric memory). In the case where information can be stored and held, the memory apparatus 33 is not limited to the NVRAM or the FeRAM, and therefore may be an apparatus, such as a magnetic memory medium.

In the toner-replenishing control apparatus 22, a control signal is outputted to the motor M as a device portion of the replenishing screw 21 for the replenishing screw 21 in the toner replenishing container 18 such that the replenishing screw 21 is rotated by a value of the rotation number (screw rotation number after correction) d corrected based on the correction table 32 shown in FIG. 6. As the motor M, a step motor is employed in order to control the rotation of the replenishing screw 21 in step units according to the rotation number d from the toner replenishing control apparatus 22.

Thus, control is possible such that there is no proportional relationship between the rotation number of the replenishing screw 21 and the replenished toner amount as in the conventional case and the rotation number (total rotation number) of the replenishing screw 21 becomes nonlinear with respect to the replenishing toner amount as shown by curve A in FIG. 12. Therefore, the suitable amount of toner is timely replenished from the toner replenishing container 18 into the developing container 10 through the toner replenishing port 20.

As described above, even in this embodiment, the toner replenishing amount required according to the measured density of the toner becomes larger. Even in the case where the rotation number of the replenishing screw 21 becomes larger, the suitable amount of toner can be always replenished into the developing container 10. Thus, the density of the toner in the developer t can be always kept constant so that a satisfactory image can be obtained.

Also, in this embodiment, the correction table corresponding to the toner replenishing container 18 can be easily stored in the memory apparatus 33 attached to the detachably attachable toner replenishing container 18. Thus, even in the case where the toner replenishing container 18 is exchanged and a new toner replenishing container is attached to the developing apparatus 4, the suitable amount of toner can be replenished into the developing container 10 according to the exchanged new toner replenishing container 18.

Figure 13:
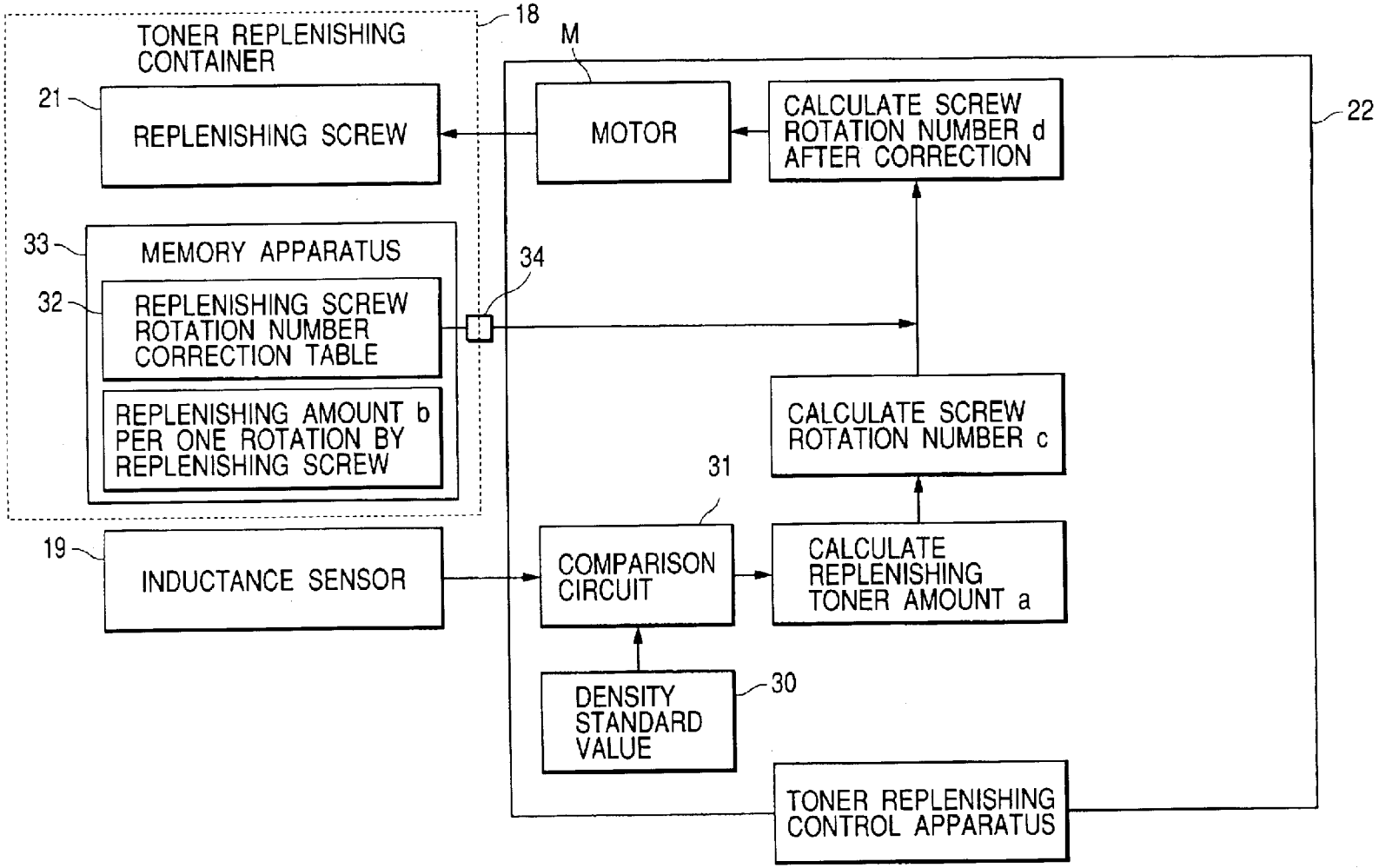
FIG. 13 is an explanatory view of toner-replenishing operating control by a toner-replenishing control apparatus in Embodiment 2 of the present invention.

Note that, as shown in FIG. 13, not only the correction table 32, but also a region for storing the toner amount fed at a time when the replenishing screw 21 is rotated one turn (replenishing amount per one rotation by screw) b are provided in the memory apparatus 33 attached to the toner replenishing container 18. Thus, the replenishing amount b per one rotation by screw may be stored in advance, the correction coefficient k corresponding to the replenishing rotation number and the replenishing amount b per one rotation by screw may be read out, and correction calculation may be conducted for the screw rotation number using the read out values by the toner-replenishing control apparatus 22 in the main body side.

(Embodiment 3)

In this embodiment, the toner replenishing container described in Embodiment 2 is applied to a color image forming apparatus.

Figure 14:
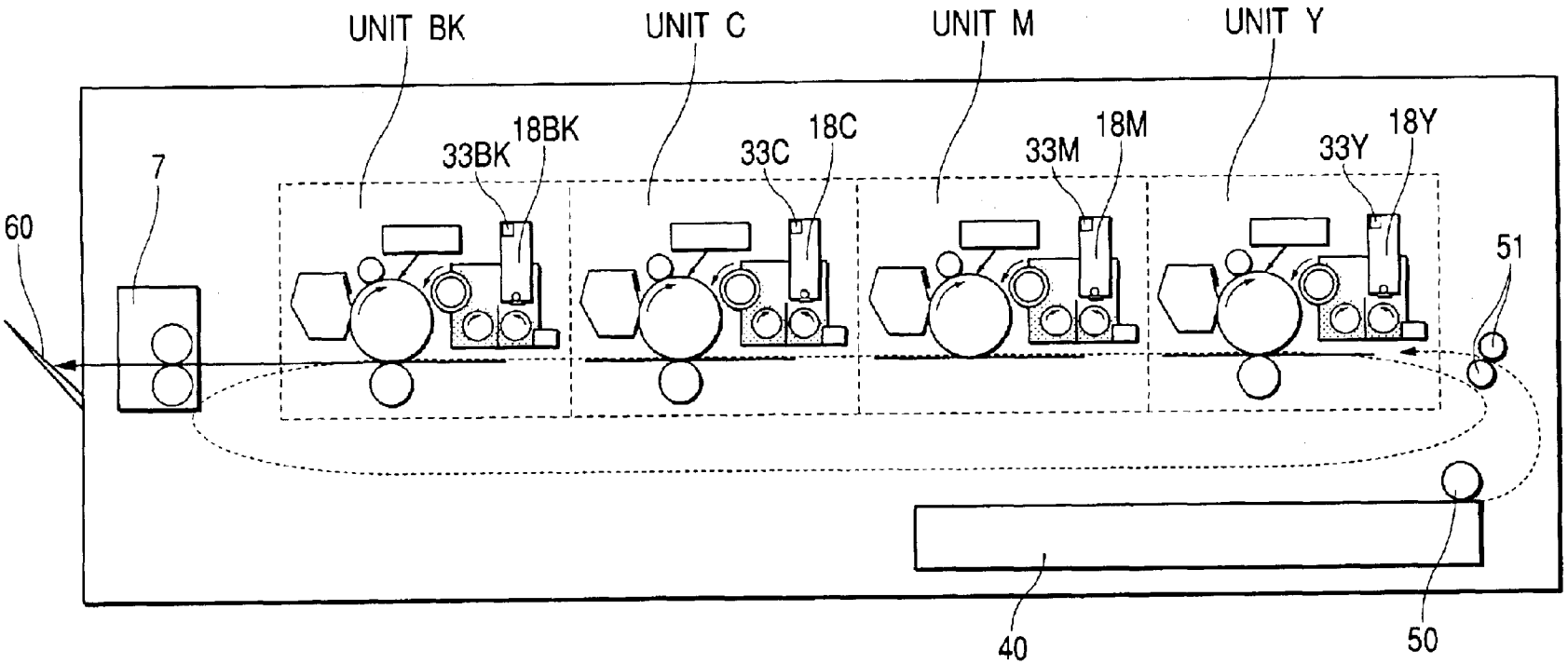
FIG. 14 is a structural view of a color image forming apparatus of Embodiment 3.

FIG. 14 is a structural view of a color image forming apparatus. The color image forming apparatus is constructed to include a plurality of photosensitive members and a plurality of toner replenishing containers, and conducts image formation using, for example, four color toners of yellow (unit Y), magenta (unit M), cyan (unit C), and black (unit BK). In this case, the toner replenishing container 18, the developing apparatus 4, the photosensitive member 1, and the like as shown in FIG. 8 are united and four units are arranged on a line. An image is formed on a photosensitive member for each color. A recording sheet is fed from a cassette 40 by a feed roller 50 and transported to respective color image forming portions in order through transporting rollers 51. After that, images are transferred to the recording sheet in succession and the transferred images are fixed by the fixing apparatus 7, and then the recording sheet is discharged to a sheet discharging tray 60.

Figure 15:
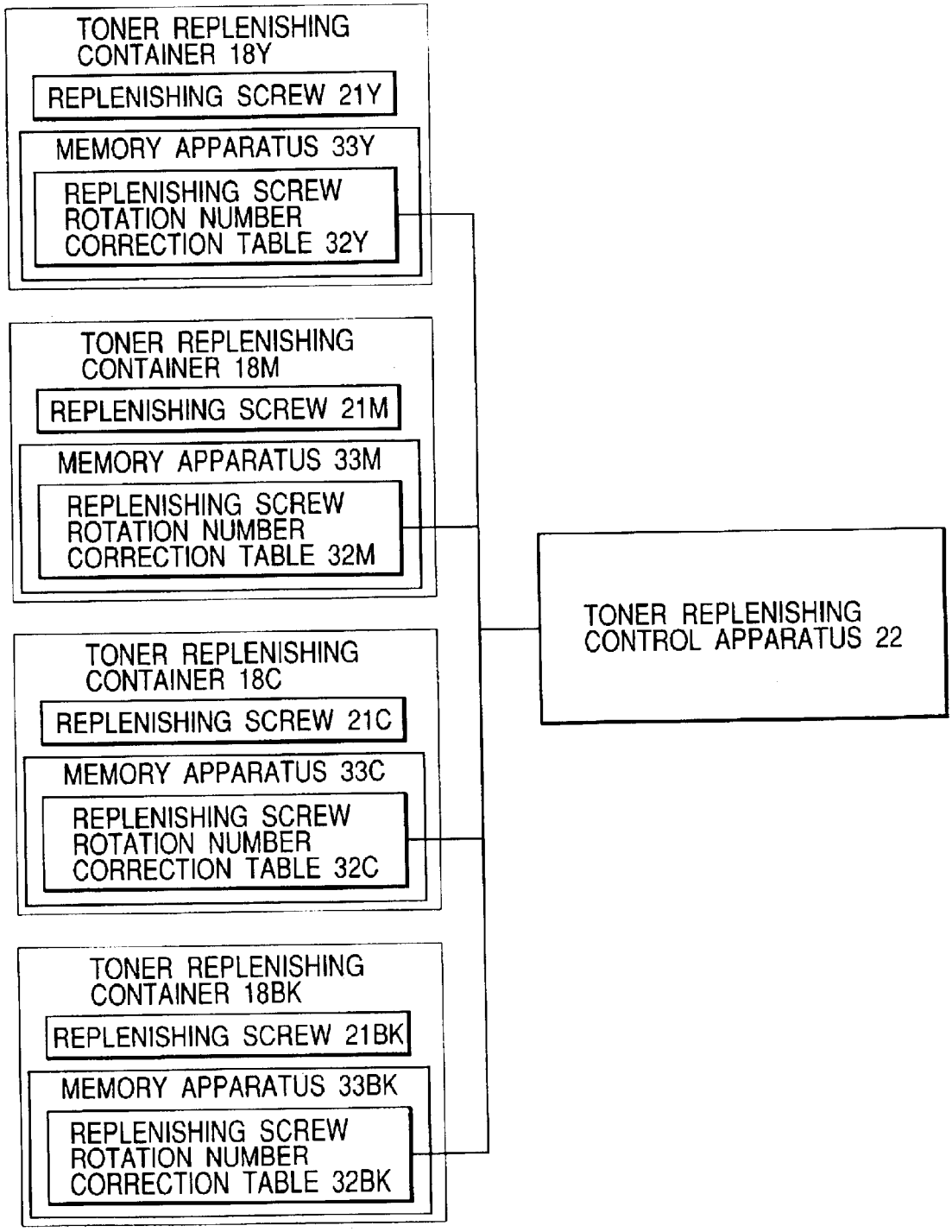
FIG. 15 is an explanatory view of toner-replenishing operating control in Embodiment 3.

In this case, as shown in FIGS. 14 and 15, memory apparatuses (33Y, 33M, 33C, and 33BK) are respectively provided in toner replenishing containers (18Y, 18M, 18C, and 18BK) for respective colors. A correction coefficient corresponding to the replenishing rotation number of the replenishing screw 21Y, 21M, 21C, 21BK according to a characteristic of each color toner is stored for respective correction tables (32Y, 32M, 32C, and 32BK). The memory apparatuses are connected with the toner replenishing control apparatus 22 and constructed to read out data by the toner-replenishing control apparatus 22.

With respect to the respective color toners, the replenished amount per one rotation by the replenishing screw is delicately changed according to the difference of flowability as a toner characteristic. Thus, it is required that the correction coefficient is changed into a correction coefficient corresponding to the flowability of each color toner and the rotation number of the replenishing screw is corrected.

Therefore, according to the structure in this embodiment, as shown in FIG. 16, the correction coefficient corresponding to the replenishing rotation number of the replenishing screw according to each color toner is used for a correction table and stored in each of the memory apparatuses (33Y, 33M, 33C, and 33BK) of the toner replenishing containers (18Y, 18M, 18C, and 18BK) for respective colors.

Thus, in the toner replenishing containers for respective colors in the color image forming apparatus, as in Embodiment 2, the rotation number of the replenishing screw can be corrected according to the characteristic (flowability) of each color toner using the correction coefficients stored in the memory apparatuses by the toner-replenishing control apparatus 22. Therefore, in the color image forming apparatus, even in the case where the toner replenishing containers for respective colors are exchanged and new toner replenishing containers are attached to the developing apparatus, the suitable amount of toner can be replenished into the developing container according to the exchanged new toner replenishing containers.

Also, as described in Embodiment 2, even in this embodiment, not only the correction table, but also a region for storing the toner amount fed at a time when the replenishing screw is rotated one turn (replenishing amount per one rotation by screw) are provided in the memory apparatus attached to the toner replenishing container for each color. Thus, the replenishing amount per one rotation for each screw may be stored in advance, the correction coefficient corresponding to the replenishing rotation number and the replenishing amount per one rotation for each screw may be read out, and correction calculation may be conducted for the screw rotation number using the read out values by the toner replenishing control apparatus in the main-body side.

Also, in this embodiment, the correction table with the numerical values as shown in FIG. 16 is used as the correction table for the screw rotation number of the replenishing screw. However, the present invention is not limited to this, and therefore a correction table with numerical values timely changed according to toner characteristics, the specifications of the developing apparatus, and the like can be also used.

Note that, according to the above-mentioned embodiments, the apparatus using the developer containing the toner and the carrier is described in detail. However, even in an image forming apparatus using only a toner, control is possible such that an optical sensor system (system for detecting a toner density from transmittance of a toner, or the like) is employed for detecting a toner density, the toner density is detected, and the rotation number of the toner replenishing screw is calculated based on the detected value and corrected.

As described above, in the case where the toner replenishing member is rotated according to the calculated replenishing toner amount, the rotation number of the toner replenishing member is nonlinearly controlled with respect to the calculated replenishing toner amount so that the toner can be suitably replenished. In addition, even in the case where a developing operation is conducted in which the toner replenishing amount required according to the measured density of the toner is large, the suitable amount of toner can be always replenished from the toner replenishing container into the developing container. Thus, the density of the toner in the developer can be always kept constant.

It is to be understood that the form of my invention herein shown and described is to be taken as a preferred example of the same and that various changes in the shape, size, and arrangement of parts may be resorted to without departing from the sprit of my invention or the scope of the attached claims.

What is claimed is:

1. An image forming apparatus for forming an image using a toner comprising:

a developer container configured to contain the toner;

a density measuring sensor configured to measure the toner density in said developer container;

a developer carrying member configured and positioned to develop an electrostatic latent image formed on an image bearing member using the toner in said developer container;

a toner replenishing member configured and positioned to supply said developer container with the toner in a toner replenishing container;

a controller configured to obtain data representing the number of rotations of said toner replenishing member based on the toner density measured by said density measuring sensor; and a memory configured to store correction information according to the number of rotations of said toner replenishing member, wherein said controller corrects the data representing the number of rotations of said toner replenishing member using the correction information stored in said memory, and controls the supply of toner to said developer container by controlling the rotation of said toner replenishing member based on the corrected data.

2. An image forming apparatus according to claim 1, wherein said controller stores information related to a toner replenishing amount per one rotation of said toner replenishing member and obtains the data representing the number of rotations of said toner replenishing member based on the toner density measured by said density measuring sensor and the information related to the toner replenishing amount per one rotation of said toner replenishing member.

3. An image forming apparatus according to claim 1, wherein said controller calculates the amount of toner to be replenished for each number of rotations of said toner replenishing member, and wherein said memory stores a plurality of correction information for correcting the calculated amount of toner to be replenished for each number of rotations of said toner replenishing member.

4. An image forming apparatus according to claim 1, wherein a cartridge is detachably attachable to said image forming apparatus, and wherein the toner replenishing container, said toner replenishing member, and said memory are integrally formed in the cartridge.

5. An image forming apparatus according to claim 1, wherein the correction information is information based on a characteristic of the toner.

6. An image forming apparatus according to claim 1, wherein said image forming apparatus conducts an image formation operation using the toner and a carrier.

7. A cartridge detachably attachable to an image forming apparatus for forming an image using a toner, said cartridge comprising:

a toner replenishing container configured to contain the toner;

a toner replenishing member configured and positioned to supply the toner to a developer portion of the image forming apparatus; and a memory configured to store information related to said cartridge, wherein said memory includes a memory region configured to store correction information according to the number of rotations of said toner replenishing member, which is obtained based on the toner density in said developer portion.

8. A cartridge according to claim 7, wherein said memory region is configured to store a plurality of correction information for each number of rotations of said toner replenishing member.

9. A cartridge according to claim 7, wherein said memory further includes a memory region configured to store information related to the amount of toner needed to be replenished per one rotation of said toner replenishing member.

10. A cartridge according to claim 7, wherein the correction information is information based on a characteristic of the toner.

11. A cartridge according to claim 7, wherein the developer portion also contains a carrier therein, wherein said cartridge causes the developer portion to contain the toner and the carrier, and wherein the image forming apparatus conducts the image formation operation using the toner and the carrier.

12. A memory device mounted in a cartridge detachably attachable to an image forming apparatus for forming an image using a toner, wherein the cartridge includes a toner replenishing container configured to contain the toner, a toner replenishing member configured and positioned to supply the toner to a developer portion of the image forming apparatus, said memory device comprising:

a memory region configured to store correction information according to the number of rotations of the toner replenishing member which is obtained based on the toner density in the developer portion.

13. A memory device according to claim 12, wherein said memory region is configured to store a plurality of correction information for each number of rotations of the toner replenishing member.

14. A memory device according to claim 12, further comprising a memory region configured to store information related to the amount of toner needed to be replenished per one rotation of the toner replenishing member.

15. A memory device according to claim 12, wherein the correction information is information based on a characteristic of the toner.

16. A memory device according to claim 12, wherein the image forming apparatus conducts an image formation operation using the toner and a carrier.

17. A control system for an image forming apparatus that forms an image using a toner and comprises an apparatus main body and a cartridge, wherein the image forming apparatus includes an image bearing member, a developer container configured to contain the toner, a density measuring sensor configured to measure the toner density in the developer container, a developer carrying member configured and positioned to develop and an electrostatic latent image formed on the image bearing member using the toner in the developer container, a toner replenishing member configured and positioned to supply the developer container with the toner in a toner replenishing containers, and a controller configured to obtain data representing the number of rotations of the toner replenishing member based on the toner density measured by the density measuring sensor, wherein said control system comprises:

a memory device mounted in the cartridge, wherein said memory device includes a memory region configured to store correction information according to the number of rotations of the toner replenishing member, and wherein said controller corrects the data representing the number of rotations of the toner replenishing member using the correction information stored in said memory region and controls the toner replenishing member to supply toner to the developer container by controlling the rotation of the toner replenishing member based on the corrected data.

18. A control system according to claim 17, wherein said memory region is configured to store a plurality of correction information for each number of rotations of the toner replenishing member.

19. A control system according to claim 17, wherein said memory device further includes:

a memory region configured to store information related to a toner replenishing amount to be replenished per one rotation of the toner replenishing member.

20. A control system according to claim 17, wherein the cartridge includes the toner replenishing container and the toner replenishing member.

21. A control system according to claim 17, wherein the correction information is information based on a characteristic of the toner.

22. A control system according to claim 17, wherein the developer container contains a carrier, wherein the controller controls an image forming operation using the toner and the carrier.

23. An image forming apparatus forming images with a plurality of image forming portions with toner contained in a developing container whose toner density is measured by a density measuring sensor and which is supplied with the toner in a toner replenishing container by a toner replenishing member, said apparatus comprising:

a controller configured to obtain data representing the number of rotations of the toner replenishing member based on the toner density measured by the density measuring sensor; and a memory configured to store correction information according to the number of rotations of the toner replenishing member, wherein said controller corrects the data representing the number of rotations of the toner replenishing member using the correction information stored in said memory, and controls the supply of the toner to the developing container by controlling the rotation of the toner replenishing member based on the corrected data.

24. An image forming apparatus according to claim 23, wherein a cartridge is detachably attachable to said image forming apparatus, and wherein the toner replenishing container, the toner replenishing member, and said memory are integrally formed in the cartridge.

25. An image forming apparatus according to claim 23, wherein the correction information is information based on a characteristic of the toner.

26. An image forming apparatus according to claim 23, wherein said image forming apparatus conducts an image formation operation using the toner and a carrier.

* * * * *

UNITED STATES PATENT AND TRADEMARK OFFICE

CERTIFICATE OF CORRECTION

PATENT NO. : 6,892,037 B2
DATED : May 10, 2005
INVENTOR(S) : Kazuhiro Ohkubo

It is certified that error appears in the above-identified patent and that said Letters Patent is hereby corrected as shown below:

Column 8,
Line 5, "(is" should read -- is --.
Line 17, "poles)" should read -- poles --.

Column 10,
Lines 11 and 13, "be always" should read -- always be --.
Lines 19 and 26, "be also" should read -- also be --.

Column 12,
Lines 18 and 20, "be always" should read -- always be --.

Column 13,
Line 54, "be also" should read -- also be --.

Column 14,
Lines 7 and 9, "be always" should read -- always be --.

Signed and Sealed this

Sixth Day of September, 2005

JON W. DUDAS
*Director of the United States Patent and Trademark Office*